US010519890B2

(12) United States Patent
Uhrich et al.

(10) Patent No.: US 10,519,890 B2
(45) Date of Patent: Dec. 31, 2019

(54) ENGINE PARAMETER SAMPLING AND CONTROL METHOD

(71) Applicant: Ford Global Technologies, LLC, Dearborn, MI (US)

(72) Inventors: Michael Uhrich, Wixom, MI (US); Ross Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 113 days.

(21) Appl. No.: 15/936,057

(22) Filed: Mar. 26, 2018

(65) Prior Publication Data

US 2019/0293015 A1 Sep. 26, 2019

(51) Int. Cl.

| | |
|---|---|
| ***F02D 41/30*** | (2006.01) |
| ***F02M 69/04*** | (2006.01) |
| ***F02D 41/22*** | (2006.01) |
| ***F02M 37/04*** | (2006.01) |
| ***F02M 37/06*** | (2006.01) |
| ***F02M 37/18*** | (2006.01) |
| ***F02D 41/26*** | (2006.01) |
| ***F02D 41/14*** | (2006.01) |

(52) U.S. Cl.

CPC ..... *F02D 41/221* (2013.01); *F02D 41/1439* (2013.01); *F02D 41/26* (2013.01); *F02D 41/3094* (2013.01); *F02M 37/043* (2013.01); *F02M 37/06* (2013.01); *F02M 37/18* (2013.01); *F02M 69/046* (2013.01); *F02D 2041/224* (2013.01); *F02D 2041/226* (2013.01); *F02D 2200/0602* (2013.01)

(58) Field of Classification Search

CPC ..... F02D 41/3094; F02D 2041/221; F02D 2041/224; F02D 2041/226; F02D 2200/0602; F02M 37/18; F02M 69/46

USPC ..... 123/431, 479; 73/114.38, 114.42, 114.43

See application file for complete search history.

(56) References Cited

U.S. PATENT DOCUMENTS

| | | | |
|---|---|---|---|
| 4,393,848 | A | 7/1983 | Poehlman |
| 5,687,696 | A | 11/1997 | Takagi et al. |
| 5,842,454 | A | 12/1998 | Miwa et al. |
| 5,878,718 | A | 3/1999 | Rembold et al. |

(Continued)

FOREIGN PATENT DOCUMENTS

| | | | |
|---|---|---|---|
| CN | 201439738 | U | 4/2010 |
| EP | 2080894 | A1 | 7/2009 |

(Continued)

OTHER PUBLICATIONS

Pursifull, R., "Fuel Rail Pressure Relief," SAE International, SAE International Technical Paper 2006-01-0626, Apr. 3, 2006, 11 pages.

*Primary Examiner* — Erik R Solis

(74) *Attorney, Agent, or Firm* — Geoffrey Brumbaugh; McCoy Russell LLP

(57) ABSTRACT

A method for operating a fluid delivery system of a vehicle powerplant is provided. The method includes sampling a fluid pressure in a port injection section of the fluid delivery system, determining if an isolation valve positioned upstream of a direct injection pump is degraded based on the fluid pressure, where the isolation valve separates the port injection section from a direct injection section, and when it is determined that the isolation valve is degraded, indicating said degradation of the isolation valve.

20 Claims, 5 Drawing Sheets

(56) References Cited

U.S. PATENT DOCUMENTS

| | | | |
|---|---|---|---|
| 5,896,843 | A | 4/1999 | Lorraine |
| 6,032,639 | A | 3/2000 | Goto et al. |
| 6,192,864 | B1 | 2/2001 | Nishimura |
| 6,227,151 | B1 | 5/2001 | Ma |
| 6,325,051 | B1 | 12/2001 | Oomori et al. |
| 6,371,094 | B1 | 4/2002 | Wagner |
| 6,374,807 | B1 | 4/2002 | Atanasyan et al. |
| 6,539,921 | B1 | 4/2003 | Matsumura |
| 6,615,801 | B1 | 9/2003 | Zdroik |
| 6,705,296 | B2 | 3/2004 | Horstmann et al. |
| 6,708,671 | B1 | 3/2004 | Joos et al. |
| 6,755,183 | B2 | 6/2004 | Frech et al. |
| 6,802,209 | B2 | 10/2004 | Joos et al. |
| 6,802,297 | B2 | 10/2004 | Braun et al. |
| 6,814,058 | B2 | 11/2004 | Oono |
| 6,871,633 | B1 | 3/2005 | Date et al. |
| 7,013,720 | B2 | 3/2006 | Date |
| 7,093,426 | B2 | 8/2006 | Ichihara et al. |
| 7,373,932 | B2 | 5/2008 | Hayashi et al. |
| 7,681,558 | B2 | 3/2010 | Gale et al. |
| 7,703,435 | B2 | 4/2010 | Sumilla et al. |
| 7,980,120 | B2 | 7/2011 | Cinpinski et al. |
| 8,151,771 | B2 | 4/2012 | Pursifull et al. |
| 8,483,932 | B2 | 7/2013 | Pursifull |
| 9,303,583 | B2 | 4/2016 | Sumilla et al. |
| 9,458,806 | B2 | 10/2016 | Zhang et al. |
| 9,683,511 | B2 | 6/2017 | Ulrey et al. |
| 2007/0017483 | A1* | 1/2007 | Tahara ..... F02D 41/221 123/431 |
| 2007/0137601 | A1 | 6/2007 | Stanglmaier |
| 2009/0205413 | A1 | 8/2009 | Yamauchi et al. |
| 2011/0139130 | A1 | 6/2011 | Siddiqui |
| 2015/0159578 | A1* | 6/2015 | Surnilla ..... F02D 41/3076 701/104 |
| 2015/0204266 | A1* | 7/2015 | Mashiki ..... F02D 41/3094 701/103 |
| 2018/0066621 | A1* | 3/2018 | Nagakura ..... F02D 41/3094 |
| 2018/0328306 | A1* | 11/2018 | Pursifull ..... F02D 41/3094 |

FOREIGN PATENT DOCUMENTS

| | | | |
|---|---|---|---|
| GB | 2310458 | A | 8/1997 |
| JP | H109073 | A | 1/1998 |
| JP | 2002089402 | A | 3/2002 |
| WO | 2004036629 | A1 | 4/2004 |
| WO | 2007116303 | A1 | 10/2007 |

* cited by examiner

ENGINE PARAMETER SAMPLING AND CONTROL METHOD

FIELD

This disclosure relates to a control system for vehicle powerplant-related operating parameters that are sampled by the control system.

BACKGROUND/SUMMARY

Vehicle powerplant systems, including engines and their related fluid delivery system, have employed various diagnostic techniques to determine if component degradation is present. Certain diagnostic routines target injector functionality, specifically, as one example.

U.S. Pat. No. 7,980,120 B2 to Cinpinski et al., discloses a system that monitors rail pressure while a pump is shut-down and an injector is actuated to determine if the injector is degraded. The inventors have recognized several drawbacks with the diagnostic method set forth U.S. Pat. No. 7,980,120. For example, the diagnostic routine requires the pump to be shut-down thereby impacting the system's ability to continue operation at a desired pressure during the diagnostic routine.

Other systems utilize a combination of multiple delivery systems, such as both direct and port injection to the engine. These combined systems allow for greater injection adaptability, thereby enabling the engine to achieve decreased emissions and increased efficiency. In these systems isolation valves may be used to separate the port injection side of the system from the direct injection side. The isolation valve may act to dampen pressure pulsations that are generated by the direct injection pump, to reduce the pump's impact on the system. However, the isolation valve may degrade (e.g., become stuck open), thereby impacting the valve's ability to dampen pressure pulses in the system. Consequently, the port injector's ability to provide repeatable injections may be diminished and noise, vibration, and harshness (NVH) in the fluid delivery system may also be increased.

To overcome at least some of the aforementioned problems a method for operating a fluid delivery system is provided. The method includes sampling a pressure in a port injection section of the fluid delivery system, determining if an isolation valve positioned upstream of a first pump is degraded based on the pressure, where the isolation valve separates the port injection section from a direct injection section, and when it is determined that the isolation valve is degraded, indicating degradation of the isolation valve. In this way, a degraded isolation valve can be accurately diagnosed and indicated. Consequently, mitigating actions and/or repairs may be carried out to reduce the unwanted impacts of the degraded isolation valve. The mitigating actions may be taken during servicing of the engine, in one example. In other examples, the mitigating actions may implemented on-board the vehicle responsive to the indication of a degraded isolation valve. For instance, the fluid delivery system may transition into a port injection mode or a direct injection mode in response to a determination that the isolation valve is degraded.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
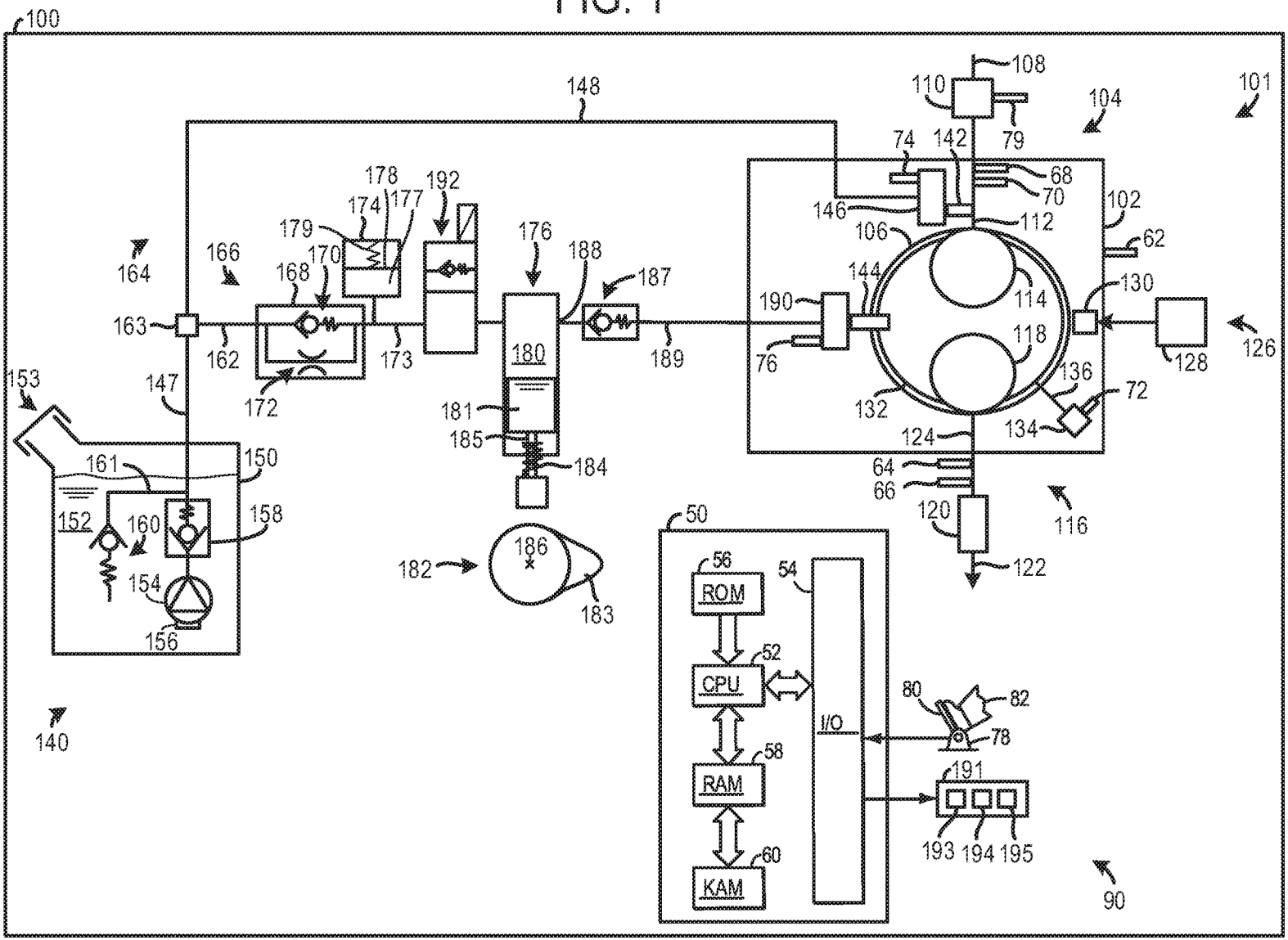
FIG. 1 shows a schematic depiction of a vehicle with an internal combustion engine and fluid delivery system.
Figure 2:
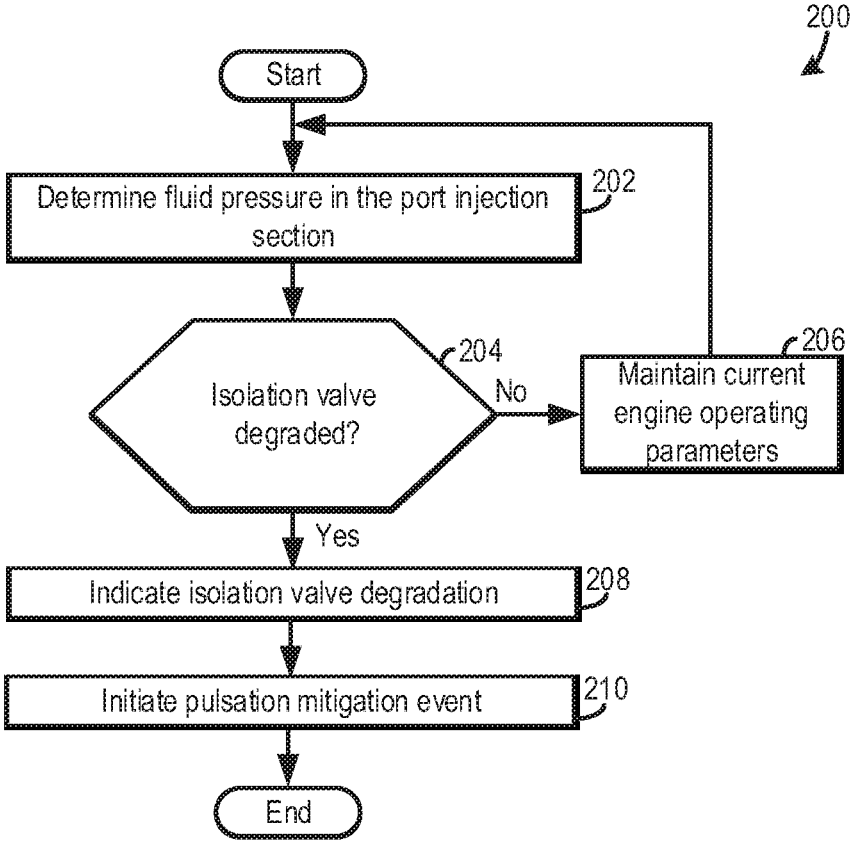
FIG. 2 shows a diagnostic method for an isolation valve in a fluid delivery system.
Figure 3:
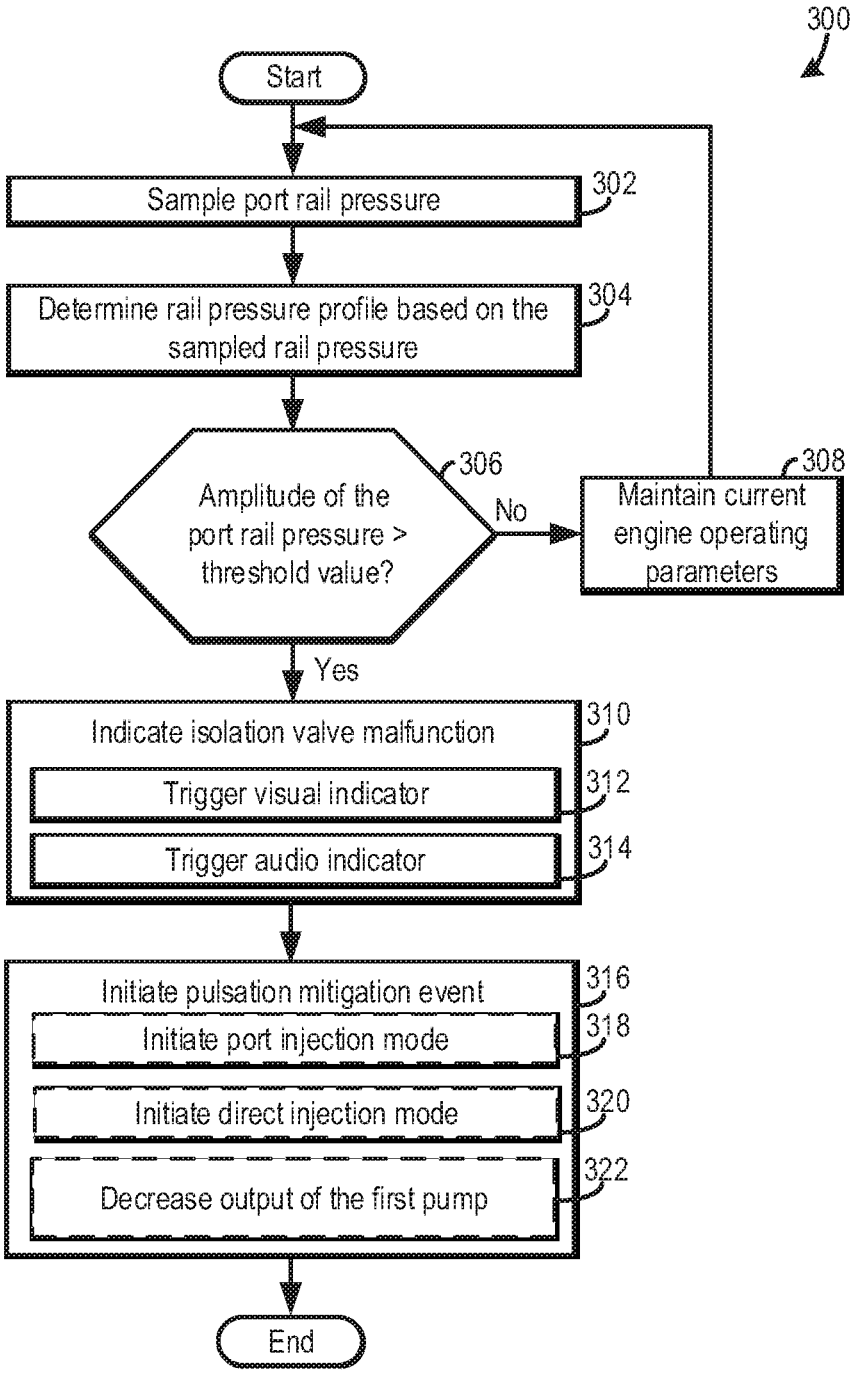
FIG. 3 shows a more detailed isolation valve diagnostic method.
Figure 4:
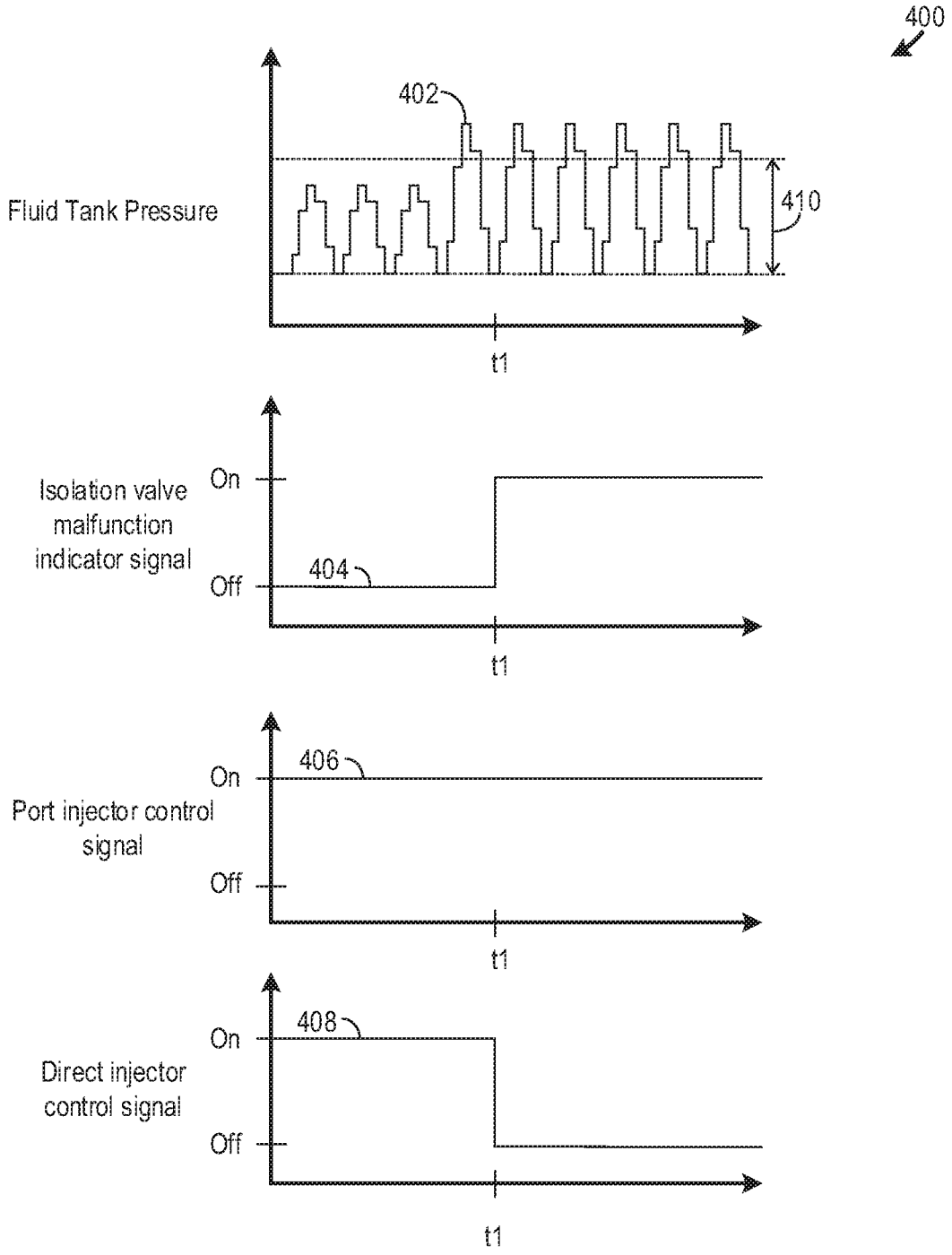
FIG. 4 shows graphs depicting a diagnostic routine for an isolation valve in a fluid delivery system.
Figure 5:
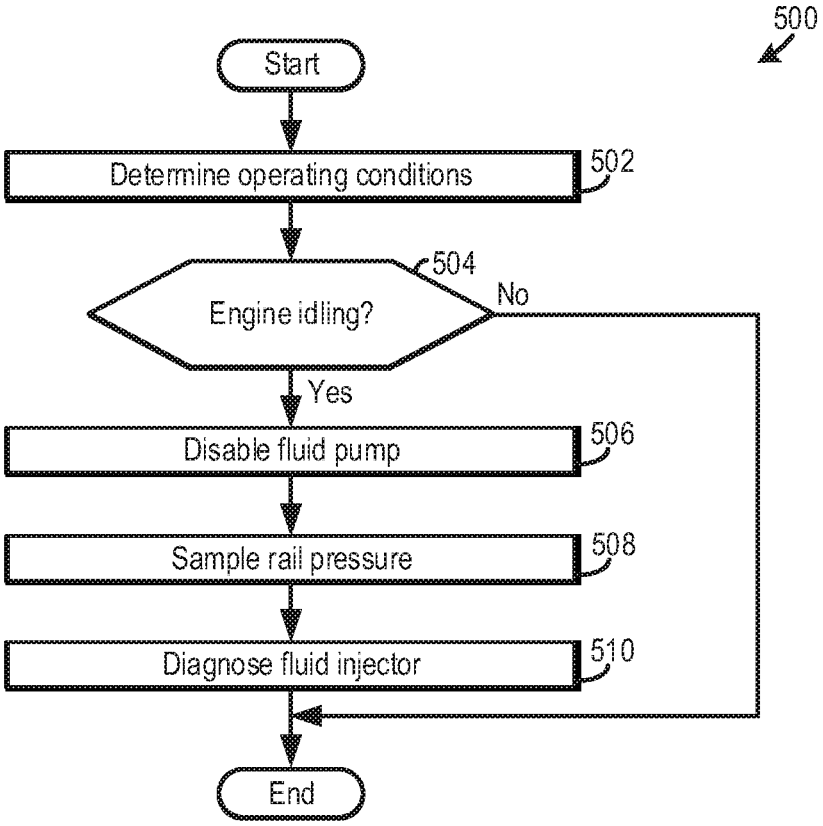
FIG. 5 shows a diagnostic method for a fluid injector.

The present description relates to vehicle powerplant systems and specifically a fluid delivery system diagnostic routine. The diagnostic routine involves sampling a pressure on a port side of a combined port and direct injection fluid delivery system. The sampled port rail pressure is used to determine if an isolation valve separating the port side of the fluid delivery system from the direct injection side of the fluid delivery system is degraded. For instance, if the amplitude of the port rail pressure surpasses a threshold value a diagnosis is made that the isolation valve is degraded (e.g., malfunctioning) and not diminishing (e.g., inhibiting) pressure pulses that travel from the direct injection pump to the port side of the system. Diagnosing a degraded isolation valve may involve alerting a vehicle technician or driver of the problem via an indicator (e.g., warning light). Thus, the indicator may prompt the driver or technician to implement fluid delivery system repairs (e.g., replacement of the isolation valve). Moreover, when port rail amplitude is used to diagnose the isolation valve, the diagnostic routine can be carried out over a wider range of operating conditions when compared to previous fluid delivery system diagnostic strategies that require a pump to be shut-down, for instance. In some examples, actions may be taken in response to the valve degradation diagnosis to mitigate the problems caused by the degradation, before the fluid delivery system can be repaired. Such problems include sending pressure pulsations into the port side of the system that reduce the likelihood of (e.g., prevent) repeatable port injection as well as cause increased noise, vibration, and harshness (NVH). The mitigating actions, in one example, may include transitioning to a port injection mode where the direct injector is shut-down, transitioning to a direct injection mode where the port injector is shut-down, or decreasing an output of a fluid pump. In this way, the likelihood of fluid delivery system degradation is reduced, thereby increasing the longevity of the system. FIG. 1 shows a schematic depiction of an internal combustion engine with a fluid delivery system designed with both port and direct injectors. FIG. 2 shows a diagnostic method for an isolation valve in a fluid delivery system. FIG. 3 shows a more detailed method for diagnosing an isolation valve in a fluid delivery system. FIG. 4 shows a graphical depiction of a diagnostic method for an isolation valve in a fluid delivery system. FIG. 5 shows a diagnostic routine for a fluid injector.

FIG. 1 shows a schematic representation of a vehicle 100 including a vehicle powerplant 101 which may include an internal combustion engine 102 and the corresponding systems. Although, FIG. 1 provides a schematic depiction of various vehicle and engine components, systems, etc., it will be appreciated that at least some of the components may have different spatial positions and greater structural complexity than the components shown in FIG. 1.

An intake system 104 providing intake air to a cylinder 106, is also depicted in FIG. 1. It will be appreciated that the cylinder may include a combustion chamber. A piston 132 is positioned in the cylinder 106. The piston 132 is coupled to a crankshaft 134 via a piston rod 136 and/or other suitable mechanical component. It will be appreciated that the crankshaft 134 may be coupled to a transmission which provides motive power to a drive wheel. Although, FIG. 1 depicts the engine 102 with one cylinder. The engine 102 may have additional cylinders, in other examples. For instance, the engine 102 may include a plurality of cylinders that may be positioned in banks.

During engine operation, the cylinder 106 typically undergoes a four-stroke cycle including an intake stroke, compression stroke, expansion stroke, and exhaust stroke. During the intake stroke, generally, the exhaust valve closes and intake valve opens. Air is introduced into the combustion chamber via the corresponding intake conduit, and the piston moves to the bottom of the combustion chamber so as to increase the volume within the combustion chamber. The position at which the piston is near the bottom of the combustion chamber and at the end of its stroke (e.g., when the combustion chamber is at its largest volume) is typically referred to by those of skill in the art as bottom dead center (BDC). During the compression stroke, the intake valve and the exhaust valve are closed. The piston moves toward the cylinder head so as to compress the air within combustion chamber. The point at which the piston is at the end of its stroke and closest to the cylinder head (e.g., when the combustion chamber is at its smallest volume) is typically referred to by those of skill in the art as top dead center (TDC). In a process herein referred to as injection, fuel is introduced into the combustion chamber. In a process herein referred to as ignition, the injected fuel in the combustion chamber is ignited via a spark from an ignition device, resulting in combustion. However, in other examples, compression may be used to ignite the air fuel mixture in the combustion chamber. During the expansion stroke, the expanding gases push the piston back to BDC. A crankshaft converts this piston movement into a rotational torque of the rotary shaft. During the exhaust stroke, in a traditional design, exhaust valve is opened to release the residual combusted air-fuel mixture to the corresponding exhaust passages and the piston returns to TDC.

The intake system 104 includes an intake conduit 108 and a throttle 110 coupled to the intake conduit. The throttle 110 is configured to regulate the amount of airflow provided to the cylinder 106. For instance, the throttle 110 may include a rotatable plate varying the flowrate of intake air passing therethrough. In the depicted example, the throttle 110 feeds air to an intake conduit 112 (e.g., intake manifold). In turn, the intake conduit 112 directs air to an intake valve 114. The intake valve 114 opens and closes to allow intake airflow into the cylinder 106 at desired time periods. Further, in other examples, such as in a multi-cylinder engine additional intake runners may branch off the intake conduit 112 and feed intake air to other intake valves. It will be appreciated that the intake conduit 112 and the intake valve 114 are included in the intake system 104. Moreover, the engine shown in FIG. 1 includes one intake valve and one exhaust valve. However, in other examples the cylinder 106 may include two or more intake and/or exhaust valves.

An exhaust system 116 configured to manage exhaust gas from the cylinder 106 is also included in the vehicle 100, depicted in FIG. 1. The exhaust system 116 includes an exhaust valve 118 designed to open and close to allow and inhibit exhaust gas flow to downstream components from the cylinder. For instance, the exhaust valve may include a poppet valve with a stem and a valve head seating and sealing on a cylinder inlet in a closed position.

The exhaust system 116 also includes an emission control device 120 coupled to an exhaust conduit 122 downstream of another exhaust conduit 124 (e.g., exhaust manifold). The emission control device 120 may include filters, catalysts, absorbers, combinations thereof, etc., for reducing tailpipe emissions. The engine 102 also includes an ignition system 126 including an energy storage device 128 (e.g., battery, capacitor, etc.,) designed to provide energy to an ignition device 130 (e.g., spark plug). Additionally or alternatively, the engine 102 may perform compression ignition.

A fluid delivery system 140 (e.g., fuel delivery system) is also shown in FIG. 1. In the use case example described herein the fluid is a liquid such a liquid fuel (e.g., gasoline, diesel, alcohol, combinations thereof, etc.) Thus, in one specific example, the fluid delivery system 140 may be a fuel delivery system. However, numerous suitable fluids may be used in the fluid delivery system. The fluid delivery system 140 provides pressurized fluid to a first injector 144 (e.g., direct fluid injector such as a direct fuel injector) and a second injector 142 (e.g., port fluid injector such as a port fuel injector). Each of the injectors may include a nozzle spraying fluid (e.g., fuel) into a targeted location in the engine at desired times in metered amounts. Injection mechanisms (e.g., solenoids, springs, valves, etc.,) in the injectors may facilitate the aforementioned injection operation. The second injector 142 is coupled to the intake conduit 112. Specifically in one example, the second injector 142 may provide fluid (e.g., fuel) to an intake port. Furthermore, the first injector 144 is coupled to the cylinder 106 and is designed to inject fluid (e.g., fuel) into the combustion chamber.

The fluid delivery system 140 also includes a port rail 146 providing fluid (e.g., fuel) to the second injector 142. As illustrated, the second injector 142 extends directly from the port rail 146. However, other suitable second injector and fluid rail configurations have been contemplated. Furthermore, in the case of a multi-cylinder engine multiple second injectors may extend from the port rail.

The port rail 146 receives fluid from a fluid conduit 148 (e.g., fuel conduit). The fluid conduit 148 is shown extending into a fluid tank 150 storing fluid 152 (e.g., a liquid such as gasoline, diesel, alcohol (e.g., methanol, ethanol, etc.,) therein. The fluid tank 150 also include a fill port 153 enabling tank refilling.

A pump 154 (e.g., lower pressure pump such as a lift fuel pump) receives fluid from the fluid tank 150 and is positioned therein, in the illustrated example. The pump 154 may include a plunger, chamber, valves, etc., that enable fluid to be flowed to downstream component and may be electrically or mechanically driven. Furthermore, in other examples the pump 154 may be positioned external to the fluid tank 150. The pump 154 includes an inlet 156 acting as a fluid pick-up. A check valve 158 is positioned downstream of the pump 154 and is designed to open when the fluid pressure exceed a predetermined threshold and reduces the likelihood (e.g., prevents) fluid from flowing upstream into an inlet of the pump. However, in other examples, the check valve downstream of the pump may not be included in the fluid delivery system.

A pressure relief valve 160 is positioned in a fluid line 161 (e.g. fuel line) branching off the fluid conduit 148. The pressure relief valve 160 is designed to open when the pressure in the fluid line 161 exceeds a threshold value. The pressure relief valve 160 may include a plunger, springs, etc., to enable this functionality. In this way, fluid can be returned into the fluid tank when, for example, downstream components are not utilizing all of the pressure head generated by the pump 154. However, in other examples, the pressure relief valve may be omitted from the fluid delivery system 140. A fluid conduit 162 (e.g., fuel conduit) branches off the fluid conduit 148 at a junction 163. The junction 163 may be positioned at a location that conceptually divides the fluid delivery system 140 into port and direct injection sections. For instance, components downstream of junction 163 that are connected to fluid conduit 148 are in a port injection section 164 (e.g., port-side) of the fluid delivery system 140 while components downstream of junction 163 that are connected to the fluid conduit 162 are in a direct injection section 166 (e.g., direct-injection side). However, in other examples, other markers may be used to divide the fluid delivery system into the port and direct injection sections. A fluid conduit 147 is positioned upstream of junction 163 and provides fluidic communication between the junction and the fluid pump 154.

An isolation valve 168 is coupled to the fluid conduit 162. The isolation valve 168 includes a check valve 170 in parallel fluidic communication with a flow restriction 172 (e.g., leak orifice). It will be appreciated that the configuration of the isolation valve 168 decreases the likelihood of pressure pulses traveling from the high pressure pump to the port rail 146 and to the fuel line downstream of the pump 154.

An accumulator 174 is coupled to a fluid conduit 173 (e.g., fuel conduit) downstream of the isolation valve 168. The accumulator 174 is designed to dampen pressure pulses generated by a pump 176 (e.g., higher pressure pump such as a direct injection fuel pump). The accumulator 174 may also enable a pressure to be maintained in the fluid delivery system after the engine is shut-down to facilitate engine restarting. The accumulator 174 includes chamber 177, a diaphragm 178, and a spring 179. The chamber 177 may be filled with fluid during accumulator while the spring and diaphragm exert a force on the fluid in the chamber to enable the pressure pulse dampening functionality. However, in other instances, the accumulator 174 may not be included in the fluid delivery system 140. Furthermore, different configurations of the accumulator have been contemplated that allow the accumulator to store fluid (e.g., fuel) and dampen pressure pulses such as multi-chamber accumulators, adjustable accumulators, etc.

The pump 176 includes a pumping chamber 180 and a plunger 181 actuated via a cam 182 including a lobe 183, the cam rotating about axis 186. The cam 182 may be rotationally coupled to the crankshaft 134 via belts, chains, other mechanical components, combinations thereof, etc. Thus, the lobe rotation may correspond to crankshaft rotation. Although FIG. 1 illustrates the higher pressure pump being driven via a single lobe it will be appreciated that multiple lobes (e.g., two or more, three or more, etc.,) may be coupled to the cam 182 and drive pumping action in the pump, in other examples. In the case of a multi-lobe pump the lobes may be equally spaced with regard to radial positioning. For instance, in the case of a two lobe pump the lobes may be spaced 180° apart while in the case of a three lobe pump the lobes may be spaced 120° degrees apart, for example. However, numerous lobes positioning configurations have been contemplated. Additionally, a spring 184 is coupled to a stem 185 in the pump 176 to enable cyclical pumping action in the pump. Furthermore, it will be appreciated that the pump 176 may have other configurations, in other examples. For instance, the pump 176 may be an electric pump. In one example, a passage may extend from a step room (e.g., a chamber opposite the compression chamber) of the pump 176 to the fluid conduit 173. However, in other examples the system may not include said passage.

A solenoid valve 192 may also be included in the fluid delivery system 140 that is coupled to the fluid conduit 173. The solenoid valve 192 is configured to regulate (e.g., increase and decrease) an amount of fluid flow there through. For instance, during direct injection operation the solenoid valve 192 may be opened and during shut-down of direct injection operation the solenoid valve 192 may be closed.

A check valve 187 is positioned downstream of an outlet 188 of the pump 176 in a fluid conduit 189 (e.g., fuel conduit). A direct injection rail 190 is in fluidic communication with the fluid conduit 189. The direct injection rail 190 provides fluid (e.g., fuel) to the first injector 144. In the depicted example, the first injector 144 extends directly from the direct injection rail 190. However, other direct injector and direct injection rail configurations have been contemplated. Additionally, in the case of a multi-cylinder engine a plurality of direct injectors may extend from the direct injection rail 190.

FIG. 1 also shows a controller 50 in the vehicle 100. It will be appreciated that the controller 50 may be included in the fluid delivery system 140 and/or vehicle powerplant 101, in some examples. The controller 50 is shown in FIG. 1 as a conventional microcomputer including: microprocessor unit 52, input/output ports 54, read-only memory 56, random access memory 58, keep alive memory 60, and a conventional data bus. Controller 50 is configured to receive various signals from sensors coupled to the engine 102, fluid delivery system 140, etc. The sensors may include engine coolant temperature sensor 62, exhaust gas composition sensor 64, exhaust gas airflow sensor 66, an intake airflow sensor 68, manifold pressure sensor 70, engine speed sensor 72, port rail sensor 74, direct injection rail sensor 76, a throttle position sensor 79, etc. Additionally, the controller 50 is also configured to receive throttle position (TP) from a pedal position sensor 78 coupled to a pedal 80 actuated by an operator 82. It will be appreciated that the pedal position sensor 78 may trigger engine speed adjustments (e.g., throttle adjustments, fuel injection adjustments, etc.).

Additionally, the controller 50 may be configured to trigger one or more actuators and/or send commands to components. For instance, the controller 50 may trigger adjustment of the throttle 110, first injector 144, second injector 142, solenoid valve 192, pump 154, pump 176, ignition device 130, energy storage device 128, intake valve 114, exhaust valve 118, etc.

Specifically in one example, the controller 50 may also send control signals to the throttle 110 to vary engine speed. The other adjustable components receiving commands from the controller may also function in a similar manner. Therefore, the controller 50 receives signals from the various sensors and employs the various actuators to adjust engine operation based on the received signals and instructions stored in memory (e.g., non-transitory memory) of the controller. Thus, it will be appreciated that the controller 50 may send and receive signals from the fluid delivery system 140. Moreover, the controller 50 may include computer readable instructions stored on non-transitory memory that when executed cause the controller to perform the various methods, diagnostic techniques, etc., described herein.

In yet another example, the amount of component, device, actuator, etc., adjustment may be empirically determined and stored in predetermined lookup tables and/or functions. For example, one table may correspond to conditions related port injection metering and another table may correspond to conditions related to direct fluid injection metering.

The controller 50 may also be configured to implement an isolation valve diagnostic routine where a fluid pressure in the port injection section 164 is sampled. However, other suitable pressure sampling locations have been contemplated such as the fluid pressure in the fluid conduit 148. Specifically in one example, the pressure sampling may be used to generate a profile and amplitude of the fluid pressure. Furthermore, the sampling may be taken over an assigned time interval. In one example, the interval may correspond to a number of lobes in the pump 176, when the pump is cam driven. For instance, the pressure sampling may be taken over a span of one pump cycle (e.g., 240 degrees of crank rotation when the pump is driven by three lobes). In this way, the pressure samples can capture a peak to peak fluid pressure pulsation amplitude. However, other sampling durations may be used such as sampling over two or more pump cycles. Additionally, the samples may be taken at a one millisecond period and stored in a buffer. However, numerous suitable sampling periods and data storage techniques have been contemplated.

After the fluid pressure is sampled the amplitude (e.g., peak to peak variance) of the pressure sample may be determined by the controller 50. If the amplitude or range exceeds a threshold value (e.g., 40 kPa, 50 kPa, 60 kPa, etc.,) it may be determined that the isolation valve is degraded due to the increased amplitude in pressure pulsations in the port injection section of the fluid delivery system.

Responsive to determining that the fluid pressure amplitude is greater than the threshold value a valve degradation indicator 191 may be triggered by the controller 50. The valve degradation indicator 191 may include an audio indicator 193, a visual indicator 194 (e.g., a warning light, graphical alert on a display, etc.,), and/or a haptic indicator 195. Furthermore, the valve degradation indicator 191 may be included in a cabin of the vehicle 100, in one example. However, other suitable indicator locations may be used, in other examples. In this way, a driver and/or vehicle technician may be alerted of an isolation valve degradation in the fluid delivery system and take actions to repair the problem. Consequently, engine efficiency may be increased and emissions may be reduced when the degraded valve is repaired.

Additionally in some examples, responsive to determining that the fluid pressure amplitude is greater than the threshold value mitigating actions implemented by the controller 50 may be taken to reduce the amplitude of, or in some cases inhibit, pressure pulsations that travel from the pump 176 into the port injection section 164 of the fluid delivery system 140. It will be appreciated that the mitigating actions may increase engine efficiency and reduce emissions by decreasing the unwanted effects of pressure pulsations on port injection.

The pulsation mitigating actions initiated by the controller 50 may include transitioning to a port injection mode where the first injector and/or the pump are disabled and port injection operation is initiated or sustained. In one example, disabling the pump (e.g., direct injection pump) may be carried out by preventing a cam from actuating the pump's plunger. Such pump deactivation may be carried out using a collapsing rocker arm or deactivated lifter, in some examples. However, other suitable deactivation mechanisms have been contemplated. Moreover, when transitioning to the port injection mode or the direct injection mode a combined port and direct injection mode may be occurring where both port and direct injection is used to provide fluid (e.g., fuel) to the cylinders in a single combustion cycle, for instance.

The mitigating actions taken by the controller 50 may also include transitioning to a direct injection mode where the second injector is disabled and the first injector operation is initiated or sustained. In this way, the fluid pressure pulsations would not influence the functionality of the second injector when it is disabled. The mitigating actions, in other examples, may also involve preventing injector to injector fuel balancing in the port injection line. Additionally, in one example, the mitigating actions may include averaging port injection pressure over a direct injection pump cycle (e.g., 240°) to use an average port injection pressure. Additionally, in another example, the mitigating actions may include ceasing pulsed pump operation and returning to closed loop power control (CLPC).

It will be appreciated that the controller 50 may be included in a control system 90 which may include the actuators, components, devices, etc., described herein. It will be appreciated that the instructions, method steps, etc., described herein may cause the control system to implement the various actions set forth in the instructions, steps, etc.

FIG. 2 shows a method 200 for operating a fluid delivery system in a vehicle powerplant. For instance, the method 200 as well as the other methods described herein may be implemented via the vehicle, engine, systems, and components described above with regard to FIG. 1. However, in other examples the method 200 and/or the other methods described herein may be implemented by other suitable vehicles, engines, systems, components, etc.

At 202 the method includes determining fluid pressure (e.g., a fluid pressure range or amplitude) in a port injection section of the fluid delivery system. Additionally, in some examples, other operating conditions may be determined such as ambient temperature, engine speed, engine load, manifold air pressure, throttle position, exhaust gas composition, exhaust gas temperature, engine temperature, etc. Moreover, the fluid's pressure (e.g., pressure range or amplitude) may be determined from signals sent from one or more pressure sensors such as a pressure sensor coupled to the port rail. Additionally or alternatively, the rail pressure may be inferred from other operating parameters, in some examples.

Next at 204 the method includes determining if an isolation valve is degraded based on the fluid pressure in the portion injection section of the fluid delivery system. In one example, the amplitude of the fluid pressure may be used to determine if the isolation valve is degraded. For instance, if the pressure amplitude surpasses a threshold value (e.g., 40 kPa, 50 kPa, 60 kPa, etc.) However, other techniques may be used to ascertain if the isolation valve is degraded.

If it is determined that the isolation valve is not degraded (NO at 204) the method proceeds to 206 where the method includes maintaining current engine operating parameters. Maintaining current engine operating parameters may include maintaining a combined port and direct injection mode where both port and direct injectors provide fluid to the engine cylinders over the course of a combustion cycle, for instance. Furthermore, it will be appreciated that the pressure pulsations generated by the pump (e.g., direct injection pump) may vary depending on operating conditions. For example, all other conditions being equal, small volume pump strokes may result in higher amplitude pulsations than large pump strokes. In a direct injection mode, the pulsations may not affect port injection accuracy. In one example, during idle the system may be operated in a port injection mode to reduce (e.g., eliminate) direct injector and/or pump noise. In the port injection mode, direct injection may be inhibited. In another example, at high load conditions, it may be desirable to operate the system in a direct injection mode. In the direct injection mode, port injection may be inhibited. On the other hand, if it is determined that the isolation valve is degraded (YES at 204) the method moves to 208. At 208 the method includes indicating isolation valve degradation (e.g., triggering a degradation indicator). Next at 210 the method may include implementing a pulsation mitigation event such as transitioning to a port injection mode, transitioning to a direct injection mode, and/or reducing an output of the pump. Method 200 enables a driver or technician to be alerted of a degraded valve in the fluid delivery system and take corrective action. Moreover, the method 200 may also allow the fluid delivery system to reduce the impacts of the pressure pulsations on the port-side of the fluid delivery system prior repair of the isolation valve.

Turning to FIG. 3 which depicts a method 300 for diagnosing an isolation valve in a fluid delivery system in a vehicle powerplant. At 302 the method includes sampling the port rail pressure. As previously discussed the rail pressure may be sampled over a span of one or more pump cycles and may be sampled at a predetermined interval such a 1.0 millisecond, 0.5 milliseconds, 2.0 milliseconds, etc. However, other suitable pressure sampling schemes may be used, in other examples.

Next at 304 the method includes determining rail pressure profile from the sampled rail pressure. For instance, the profile and amplitude of the peak to peak pulsations in the profile may be generated at step 304.

At 306 the method includes determining if the amplitude of the port rail pressure profiles is greater than a threshold value (e.g., 40 kPa, 50 kPa, 60 kPa, 80 kPa, etc.) If it is determined that the amplitude of the port rail pressure does not exceed the threshold value (NO at 306) the method includes at 308 maintaining current engine operating parameters. For instance, a fluid injection mode where both port and direct injection is used to provide fluid to the engine cylinders over the course of a combustion cycle may be maintained. However, in other examples, a port or a direct injection mode may be maintained.

On the other hand, if it is determined that the amplitude of the port rail pressure does exceed the threshold value (YES at 306) the method moves to 310. At 310 the method includes indicating isolation valve degradation. Indicating isolation valve degradation may include steps 312 and 314. At 312 a visual indicator is triggered and at 314 an audio indicator is triggered.

Next at 316 the method includes initiating a fluid pressure pulsation mitigating event which may include steps 318, 320, and/or 322. At 318 the method includes implementing a port injection mode where port injection is permitted and direct injection is inhibited. It will be appreciated that the implementation of said mode or the other modes described herein may include transitioning from one mode to another mode. At 320 the method may include implementing a direct injection mode where direct injection is permitted and port injection is disabled. At 322 the method may include decreasing an output of the higher pressure pump.

Now turning to FIG. 4, example map 400 graphically depicts port rail pressure, a valve degradation indicator signal, a second injector control signal, and a direct injector control signal. It will be appreciated that the map 400 may correspond to examples of signals and pressures that occur during the diagnostic routines shown in FIGS. 2 and/or 3, for instance.

Moreover, the map 400 may correspond to the vehicle, engine, fluid delivery system, and corresponding components described above with regard to FIG. 1. The example of FIG. 4 is drawn substantially to scale, even though each and every point is not labeled with numerical values. As such, relative differences in timings can be estimated by the drawing dimensions. However, other relative timings may be used, if desired.

A pressure curve for the port rail is indicated at 402. An isolation valve degradation indicator signal is illustrated at 404. A port control signal is indicated at 406. The signal includes an "ON" condition and an "OFF" condition. The "ON" conditions indicates that the second injector is performing injection into an intake conduit at desired time intervals while an "OFF" condition is a condition where the second injector is inhibited from performing injection.

A direct control signal is indicated at 408. The signal includes an "ON" condition and an "OFF" condition. The "ON" conditions indicates that the direct injector is performing fluid injection into the cylinder at desired time intervals while an "OFF" condition is a condition where the direct injector is inhibited from performing fluid injection.

At t1, the amplitude of the pressure curve 402 exceeds a threshold value 410. Responsive to the amplitude exceeding the threshold value 408 the valve degradation indicator is turned on and the fluid delivery system is transitioned from a combined port and direct injection mode to a port injection mode where port injection is permitted and direct injection is inhibited. Alternatively, a direct injection mode may be implemented where direct injection is permitted and port injection is inhibited. The type of injection mode may be chosen based on operating conditions such as engine load, engine speed, pedal position, engine temperature, etc.

The technical effect of diagnosing the isolation valve is to increase engine efficiency and/or reduce emissions by prompting a driver and/or a technician to repair a degraded isolation valve in a fluid delivery system and/or taking corrective action to reduce the unwanted effects (e.g., NVH and port injection operation interference) of a degraded fluid delivery system isolation valve.

FIG. 5 shows a method 500 for diagnosing a fluid injector such as the port or direct injectors described above with regard to FIG. 1. It will be appreciated that the method 500 may be carried out independently from the other methods described herein.

At 502 the method includes determining operating conditions. The operating conditions may include engine speed, engine load, engine temperature, pump output, etc. Next at 504 the method includes determining if the engine is idling. Engine idle may be determined based on a threshold idle speed. The threshold idle speed may be 500 RPM, 600 RPM, 1000 RPM, etc. Thus, it may be determined that the engine is idling when the engine speed is less than the idle threshold or within an idle speed range.

If it is determined that the engine is not idling (NO at 504) the method ends. On the other hand, if it is determined that the engine is idling (YES at 504) the method moves to 506 where the method includes disabling a fluid pump. For instance, a high pressure pump (e.g., direct injection pump) may be disabled. However, in other examples, a lower pressure pump (e.g., lift pump) may additionally or alternatively be disabled.

Next at 508 the method includes sampling rail pressure. For instance, a fluid pressure in a direct injector rail may be sampled and/or a fluid pressure in a port rail may be sampled. At 510 the method includes diagnosing the fluid injector (e.g., a direct fluid injector or a port fluid injector) based on the sampled rail pressure. For instance, the sampled pressure during actuation of the fluid injector may be compared to an expected rail pressure to ascertain if the fluid injector is functioning as expected. If it is determined that the fluid injector is not functioning as desired an injector degradation indicator may be triggered and/or corrective actions may be taken such as actuating the injector or adjusting the fluid output of the injector during injection, for instance.

The invention will be further described in the following paragraphs. In one aspect, a method for operating a fluid delivery system in a vehicle powerplant, including sampling a fluid pressure in a port injection section of the delivery system, determining if an isolation valve positioned upstream of a first pump is degraded based on the fluid pressure, where the isolation valve separates the port injection section from a direct injection section, and indicating isolation valve degradation in response to the determination. The method may further comprise, in one example, transitioning to a direct injection mode where a second injector is disabled in response to the determination of isolation valve degradation. The method may further include in one example, transitioning to a port injection mode where the first pump is disabled in response to the determination of isolation valve degradation. In yet another example the method may further include decreasing an output of the first pump positioned downstream of the isolation valve in response to the determination of isolation valve degradation.

In another aspect, a fluid delivery system in a vehicle powerplant is provided that includes a first pump in fluidic communication with a second pump, the second pump including an inlet opening into a tank, a second injector and a port rail receiving fluid from the second pump, a first injector receiving fluid from the first pump, an isolation valve positioned upstream of the first pump, and a controller including computer readable instructions stored on non-transitory memory that when executed cause the controller to sample a port rail pressure determine if the isolation valve is degraded based on the port rail pressure, and indicate degradation of the isolation valve in response to determining isolation valve degradation.

In yet another aspect, a method for operating a fluid delivery system that includes sampling a fluid pressure in a port rail, generating a rail pressure profile based on the sampled fluid pressure, determining if an isolation valve positioned upstream of a pump is degraded when an amplitude of the rail pressure profile exceeds a threshold value, and indicating degradation of the isolation valve in response to determining isolation valve degradation. The method may also include in one example transitioning to a direct injection mode where a second injector is disabled in response to determining isolation valve degradation. The method may further include transitioning to a port injection mode where the first pump is disabled in response to determining isolation valve degradation.

In any of the aspects or combinations of the aspects, determining if the isolation valve is degraded may include determining if an amplitude of a profile of the fluid pressure exceeds a threshold value.

In any of the aspects or combinations of the aspects, the isolation valve may include a leak orifice in parallel fluidic communication with a check valve.

In any of the aspects or combinations of the aspects, the sampling of the fluid pressure may occur in a conduit in direct fluidic communication with a port rail in the port injection section.

In any of the aspects or combinations of the aspects, the sampling of fluid pressure may occur in a port rail in the port injection section of the fluid delivery system.

In any of the aspects or combinations of the aspects, the port injection section of the fluid delivery system may include a port rail and a conduit in direct fluidic communication with the port rail.

In any of the aspects or combinations of the aspects, sampling of fluid pressure may occur in a port rail in the port injection side of the fluid delivery system.

In any of the aspects or combinations of the aspects, a duration of the fluid pressure sampling may be determined based on a number of lobes actuating the first pump.

In any of the aspects or combinations of the aspects, sampling the port rail pressure may include sampling a pressure from a pressure sensor coupled directly to the port rail.

In any of the aspects or combinations of the aspects, the first pump may be driven via at least one cam lobe.

In any of the aspects or combinations of the aspects, the fluid delivery system may further include computer readable instructions stored on non-transitory memory that when executed cause the controller to, when it is determined that the isolation valve is degraded, transition to a direct injection mode where the second injector is disabled.

In any of the aspects or combinations of the aspects, the fluid delivery system may further include computer readable instructions stored on non-transitory memory that when executed cause the controller to, when it is determined that the isolation valve is degraded, transition to a port injection mode where the pump is disabled.

In any of the aspects or combinations of the aspects, the fluid delivery system may further include computer readable instructions stored on non-transitory memory that when executed cause the controller to, when it is determined that the isolation valve is degraded decrease an output of the first pump positioned downstream of the isolation valve.

In any of the aspects or combinations of the aspects, determining if the isolation valve is degraded may include determining if an amplitude of a profile of the port rail pressure exceeds a threshold value.

In any of the aspects or combinations of the aspects, a duration of the fluid pressure sampling may be determined based on a number of lobes actuating the first pump.

Note that the example control and estimation routines included herein can be used with various engine, and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to other types of engines (V-6, I-4, I-6, V-12, opposed 4, etc.,), vehicle systems, etc. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

It will further be appreciated by those skilled in the art that although the invention has been described by way of example with reference to several embodiments it is not limited to the disclosed embodiments and that alternative embodiments could be constructed without departing from the scope of the invention as defined in the appended claims.

The invention claimed is:

1. A method for operating a fluid delivery system in a vehicle powerplant, comprising:

sampling a fluid pressure in a port injection section of the delivery system;

determining if an isolation valve positioned upstream of a first pump is degraded based on the fluid pressure, where the isolation valve separates the port injection section from a direct injection section; and indicating isolation valve degradation in response to the determination.

2. The method of claim 1, where determining if the isolation valve is degraded includes determining if an amplitude of a profile of the fluid pressure exceeds a threshold value.

3. The method of claim 1, further comprising transitioning to a direct injection mode where a second injector is disabled in response to the determination of isolation valve degradation.

4. The method of claim 1, further comprising transitioning to a port injection mode where the first pump is disabled in response to the determination of isolation valve degradation.

5. The method of claim 1, further comprising decreasing an output of the first pump positioned downstream of the isolation valve in response to the determination of isolation valve degradation.

6. The method of claim 1, where the isolation valve includes a leak orifice in parallel fluidic communication with a check valve.

7. The method of claim 1, where the sampling of the fluid pressure occurs in a conduit in direct fluidic communication with a port rail in the port injection section.

8. The method of claim 1, where the sampling of fluid pressure occurs in a port rail in the port injection section of the fluid delivery system.

9. The method of claim 1, where a duration of the fluid pressure sampling is determined based on a number of lobes actuating the first pump.

10. A fluid delivery system in a vehicle powerplant comprising:

a first pump in fluidic communication with a second pump, the second pump including an inlet opening into a tank;

a second injector and a port rail receiving fluid from the second pump;

a first injector receiving fluid from the first pump;

an isolation valve positioned upstream of the first pump; and a controller with computer readable instructions stored on non-transitory memory that when executed cause the controller to:

sample a port rail pressure;

determine if the isolation valve is degraded based on the port rail pressure; and indicate degradation of the isolation valve in response to determining isolation valve degradation.

11. The fluid delivery system of claim 10, where sampling the port rail pressure includes sampling a pressure from a pressure sensor coupled directly to the port rail.

12. The fluid delivery system of claim 10, where the first pump is driven via at least one cam lobe.

13. The fluid delivery system of claim 10, further comprising computer readable instructions stored on non-transitory memory that when executed cause the controller to:

transition to a direct injection mode where the second injector is disabled in response to determining isolation valve degradation.

14. The fluid delivery system of claim 10, further comprising computer readable instructions stored on non-transitory memory that when executed cause the controller to:

transition to a port injection mode where the first pump is disabled in response to determining isolation valve degradation.

15. The fluid delivery system of claim 10, further comprising computer readable instructions stored on non-transitory memory that when executed cause the controller to:

decrease an output of the first pump positioned downstream of the isolation valve in response to determining isolation valve degradation.

16. The fluid delivery system of claim 10, where determining if the isolation valve is degraded includes determining if an amplitude of a profile of the port rail pressure exceeds a threshold value.

17. A method for operating a fluid delivery system comprising:

sampling a fluid pressure in a port rail;

generating a rail pressure profile based on the sampled fluid pressure;

determining if an isolation valve positioned upstream of a pump is degraded when an amplitude of the rail pressure profile exceeds a threshold value; and indicating degradation of the isolation valve in response to determining isolation valve degradation.

18. The method of claim 17, further comprising transitioning to a direct injection mode where a second injector is disabled in response to determining isolation valve degradation.

19. The method of claim 17, further comprising transitioning to a port injection mode where the pump is disabled in response to determining isolation valve degradation.

20. The method of claim 17, where a duration of the fluid pressure sampling is determined based on a number of lobes actuating the pump.

* * * * *